US006317109B1

(12) United States Patent
Lee

(10) Patent No.: US 6,317,109 B1
(45) Date of Patent: Nov. 13, 2001

(54) LIQUID CRYSTAL DISPLAY APPARATUS WITH RESIDUAL IMAGE ELIMINATING FUNCTION

(75) Inventor: Hyun Chang Lee, Kyongki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/078,523

(22) Filed: May 15, 1998

(30) Foreign Application Priority Data

May 17, 1997 (KR) ..... 97-19141

(51) Int. Cl.[7] ..... G09G 3/36
(52) U.S. Cl. ..... 345/87
(58) Field of Search ..... 345/87, 96, 92; 349/42, 43

(56) References Cited

U.S. PATENT DOCUMENTS 5,173,687 * 12/1992 Tanaka et al. ..... 345/94
6,040,814 * 3/2000 Murakami et al. ..... 345/94

FOREIGN PATENT DOCUMENTS 7-129127 5/1995 (JP) .
94-6414 3/1994 (KR) .

* cited by examiner

*Primary Examiner*—Richard Hjerpe
*Assistant Examiner*—Ronald Laneau
(74) *Attorney, Agent, or Firm*—Finnegan, Henderson, Farabow, Garrett & Dunner L.L.P.

(57) ABSTRACT

A liquid crystal display apparatus with a residual image eliminating function which can display a fine picture without a residual image on a liquid crystal display panel. The liquid crystal display apparatus compares image signals from an input line in the frame unit using a still picture detector and detect if a still picture has been displayed on the liquid crystal display panel for more than a certain time. An output signal of this still picture detector allows a data compensating means to selectively compensate an image signal in the frame unit to be supplied to the liquid crystal display panel. A direct-current voltage component accumulated in the liquid crystal cells included in the liquid crystal display panel is eliminated by the compensated image signal so that a, residual image can not appear on the liquid crystal display panel.

18 Claims, 9 Drawing Sheets

LIQUID CRYSTAL DISPLAY APPARATUS WITH RESIDUAL IMAGE ELIMINATING FUNCTION

BACKGROUND OF THE INVENTION

1. Field of the Invention

This invention relates to a liquid crystal display apparatus for displaying a picture on a liquid crystal display panel employing a thin film transistor (TFT), and more particularly to a liquid crystal display apparatus having a residual image eliminating function so that it is capable of displaying a fine picture without a residual image.

2. Description of the Prior Art

Recently, there has been accelerating the development of a flat display device of the so-called active matrix driven type, for example, a liquid crystal display device employing TFTs. Since such a liquid crystal display device can be miniaturized compared with the Brown tube or cathode ray tube, it is commercially available in the market as a display device such as a portable television, lap-top type personal computer, or the like. Further, this liquid crystal display device reverses the polarity of a voltage applied to a liquid crystal cell every frame in order to reduce the driving voltage of the liquid crystal display panel.

In the liquid crystal display device employing TFTs, however, the voltage applied to the liquid crystal changes symmetrically due to the parasitic capacitance of the TFTs. This brings about a deterioration of the picture displayed on the liquid crystal causing the appearance of a residual image on the liquid crystal display panel. In order to overcome such picture deterioration, the conventional liquid crystal display device modulates the common voltage applied to the liquid crystal cell. The conventional device, however, still displays a residual image when a different picture is displayed after the same picture had been displayed for a long time. This results from the direct current (DC) component of the applied voltage being accumulated in the liquid crystal cell by a certain amount according to the progress of the frame in the case where the same picture has been displayed on the liquid crystal display panel for a long time. This phenomenon will be explained in more detail with reference to the drawings below.

Referring to FIG. 1, there is shown a picture element or pixel cell of a liquid crystal display panel which comprises a TFT 10 having a gate connected to a scanning line 11 and a source connected to a data line 13, a liquid crystal cell 12 connected between a drain of the TFT 10 and a common voltage source $V_{COM}$, and an auxiliary capacitor 14. The TFT 10 is selectively turned on by a scanning control signal Vg in a pulse form on scanning line 11 to connect the data line 13 to the liquid crystal cell 12 and the auxiliary capacitor 14. When the TFT 10 is turned on, the liquid crystal cell 12 and auxiliary capacitor 14 accumulate the voltage of an image signal $V_D$ from the data line 13, thereby maintaining the accumulated voltage until the TFT 10 is turned on again. Because of the parasitic capacitance of the TFT 10, however, a voltage $V_S$ accumulated in the liquid crystal cell 12 and the auxiliary capacitor 14 suddenly changes up to a voltage equal to the voltage in the data line 13 when the TFT 10 is turned on, and thereafter changes to a lower voltage than the voltage in the data line 13 when the TFT 10 is turned off. Meanwhile, the positive polarity voltage and the negative polarity voltage applied to the liquid crystal cell 12 have different absolute values with respect to each other. As a result, when the same picture is displayed on the liquid crystal display panel for a certain time, a DC voltage component is accumulated by a certain amount in the liquid crystal cell 12 according to the progress of frame. This DC component accumulated in the liquid crystal cell 12 causes a residual image to be displayed on the liquid crystal panel when the picture changes.

As described above, a method of changing the common voltage VCOM applied to the liquid crystal cell 12 has been suggested as a strategy for eliminating the residual image caused by the parasitic capacitance of the TFT 10. However, this method fails to adequately compensate for the DC voltage accumulated in the liquid crystal cell 12 because the DC voltage accumulated in the liquid crystal cell 12 changes depending on the voltage on the data line 13. This results in a residual image still appearing in the above common voltage varying method.

Specifically, if a voltage $V_D$ in the data line 13 is 5 V higher than the common voltage $V_{COM}$, then a varied voltage $\Delta V_{S(5V)}$in the liquid crystal cell 12 becomes large; while if a voltage $V_D$ in the data line 13 is equal to the common voltage $V_{COM}$, then a varied voltage $\Delta V_{S(DV)}$ in the liquid crystal cell 12 becomes small. The varied voltage $\Delta V_{S(5V)}$ in the liquid crustal cell 12 when the voltage $V_D$ in the data line 13 is 5 V higher than the common voltage $V_{COM}$, and the varied voltage $\Delta V_{5(OV)}$ in the liquid crystal cell 12 when the voltage $V_D$ in the data line 13 is equal to the common voltage $V_{COM}$, can be respectively represented by two expressions as follows:

$$\Delta V_{S(5V)}=C_{gd}(V_{gh}-V_{gl})/(C_{LC(ON)}+C_{S+}C_{DS+}C_{gd}) \quad (1)$$

$$\Delta V_{S(OV)}=C_{gd}(V_{gh}-V_{gl})/(C_{LC(OFF)}+C_{st}+C_{DS}+C_{gd} \quad (2)$$

where, $C_{gd}$ is the capacitance between the gate and drain (or source), $V_{gh}$ and $V_{gl}$ are the high and low voltages applied to the gate, respectively, $C_{LC(ON)}$ and $C_{LC(OFF)}$ are the capacitances of the liquid crystal cell with and without an applied voltage, respectively, $C_{st}$ is the storage capacitance, and $C_{ds}$ is the capacitance between the source and drain. As seen from the above expressions, the absolute value difference between the positive polarity voltage and the negative polarity voltage applied to the liquid crystal cell 12 increases in accordance with the increase of the voltage on the data line 13, and hence an amount of the DC voltage accumulated in the liquid crystal cell 12 every frame is different. On the other hand, since it is difficult to apply a different common voltage $V_{COM}$ to each liquid crystal cell 12, the common voltage cannot be changed in response to a voltage variation in the data line 13. For this reason, it is impossible to eliminate a residual image completely in the conventional liquid crystal display device employing the above mentioned common voltage varying method.

For example, it is assumed that the common voltage $V_{COM}$ was lowered by the intermediate voltage $\Delta V_{S(M)}$ between the varied voltage $\Delta V_{S(5V}$ in the liquid crystal cell 12 when the voltage $V_D$ in the data line 13 is 5 V higher than the common voltage $V_{COM}$ and the varied voltage $\Delta V_{S(OV)}$ in the liquid crystal cell 12 when the voltage $V_D$ in the data line 13 is equal to the common voltage $V_{COM}$, as expressed in the following formula:

$$\Delta V_{S(M)}=[C_{gd}/(C_{LC(ON)}+C_{st}+C_{ds}+C_{gd})-\mathrm{Cgd}/(C_{LC(OFF)}+C_{st}+C_{ds}+C_{gd})\cdot(V_{gh}-V_{gl})/2]+[C_{gd}/(C_{LC}+C_{st}+C_{ds}+C_{gd})]\cdot(V_{gh}-V_{gl}) \quad (3)$$

Further, provided that a voltage of 5 V is supplied to the data line 13, a DC voltage of positive polarity (+) accumulates in the liquid crystal cell 12 every frame. Otherwise, provided that a voltage of OV is supplied to the data line 13, a direct-current voltage of negative polarity (−) accumulates in the liquid crystal cells 12 every frame. By this positive or negative polarity DC voltage, a residual image appears on the liquid crystal display panel.

Another alternative for eliminating this residual image is a liquid crystal display apparatus that corrects the image signal every frame, as disclosed in Japanese Patent Ladeopen Publication No. Puyng 3-212815, published on Sep. 18, 1991 and filed by Nippon Victor Co., Ltd. The liquid crystal display apparatus according to the Japanese patent publication could eliminate a residual image appearing on the liquid crystal display panel by calculating a varied differential signal on the basis of a differential signal between fields for every frame. That is, the apparatus calculates a differential signal between adjacent scanning lines and the level of the image signal and by then adding the varied differential signal to the image signal. This liquid crystal display apparatus, however, has a disadvantage in that, since it utilizes a differential signal between fields composed of one picture, that is, a differential signal between adjacent scanning lines, the image signal may be distorted. Thus, a distorted picture different from the original picture may be displayed on the liquid crystal display panel.

SUMMARY OF THE INVENTION

Accordingly, it is an object of the present invention to provide a liquid crystal display apparatus with a residual image eliminating function which can display a fine picture without a residual image on the liquid crystal display panel.

It is further an object of the present invention to provide a method of preventing a residual image from appearing on the liquid crystal display panel.

In order to attain these and other objects of the invention, a liquid crystal display apparatus with a residual image eliminating function according to one aspect of the present invention includes means for receiving an image signal on an input line, means for determining a compensation voltage corresponding to a directcurrent voltage amount accumulated in a liquid crystal cell, and a data compensator for compensating the image signal with the compensation voltage.

Further, a liquid crystal display apparatus with a residual image eliminating function according to another aspect of the present invention includes means for receiving an image signal on an input line, means for determining a compensation voltage corresponding to a direct-current voltage amount accumulated in a liquid crystal cell, a data compensator for compensating the image signal with the compensation voltage, and a common voltage generator for varying a common voltage to compensate for the accumulated direct-current voltage.

A residual image eliminating method according to an aspect of the present invention includes the steps of receiving an image signal on an input line, determining a compensation voltage corresponding to a direct-current voltage amount accumulated in a liquid crystal cell, and compensating the image signal with the compensation voltage.

A residual image eliminating method according to another aspect of the present invention includes the steps of receiving an image signal on an input line, determining a compensation voltage corresponding to a direct-current voltage amount accumulated in a liquid crystal cell, compensating the image signal with the compensation voltage, and varying a common voltage to compensate for the accumulated direct-current voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED ZMBODTMENT

Figure 1:
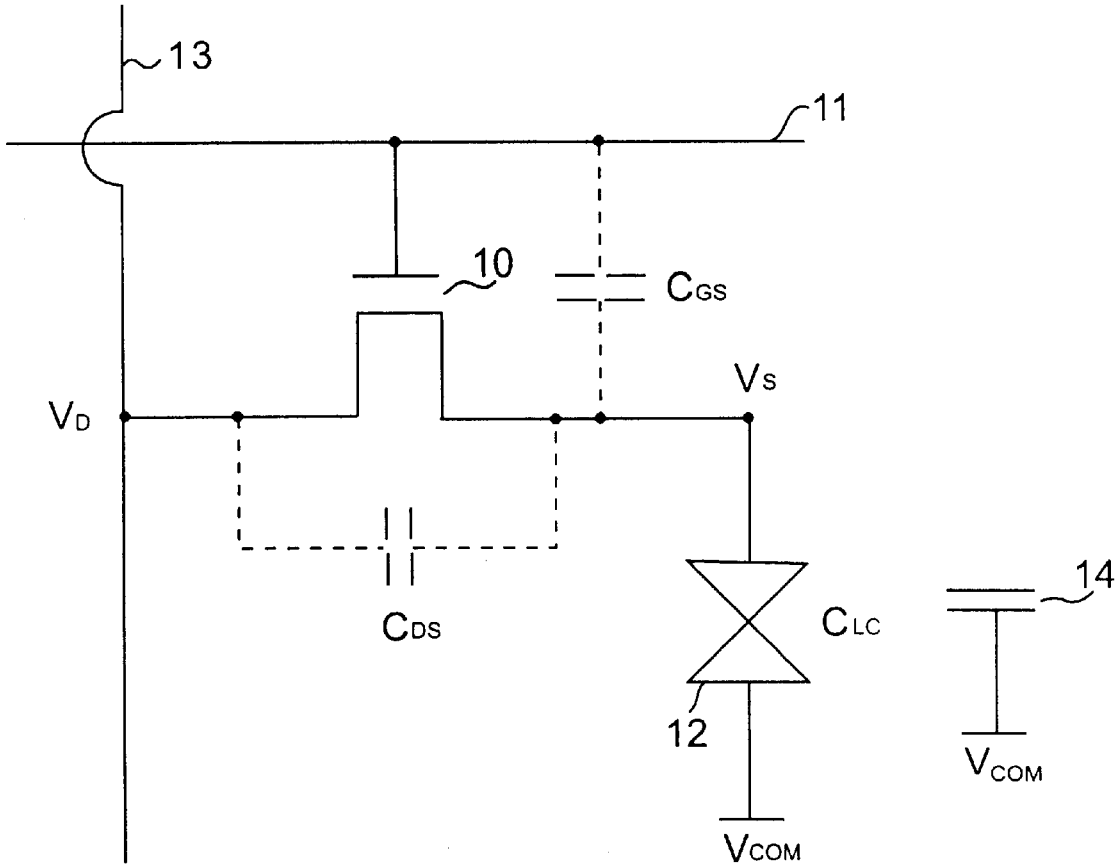
FIG. 1 PRIOR ART
FIG. 1 is an equivalent circuit diagram, of a picture element cell of the conventional liquid crystal display panel employing a thin film transistor.
Figure 2:
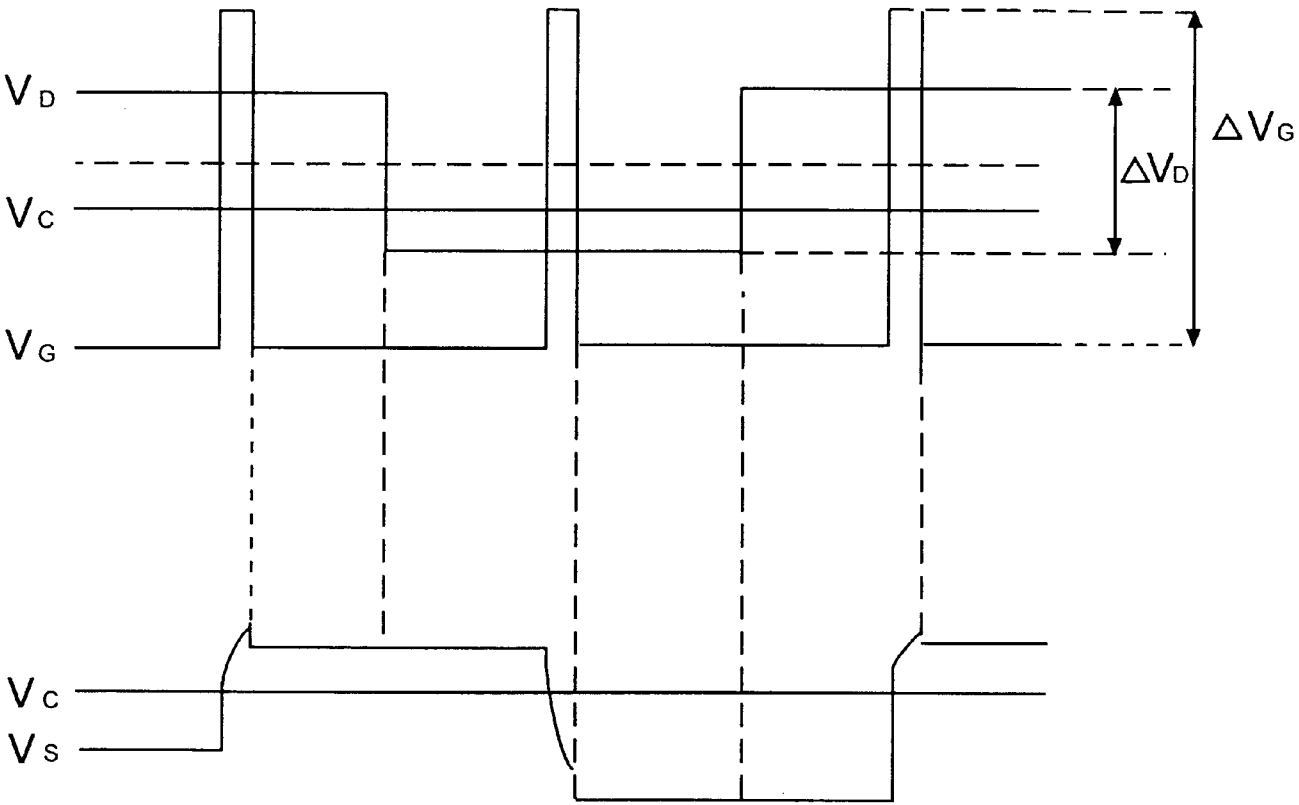
FIG. 2 PRIOR ART
FIG. 2 is a waveform diagram of voltages applied to the liquid crystal cell at the time of driving the TFT shown in FIG. 1.
Figure 3:
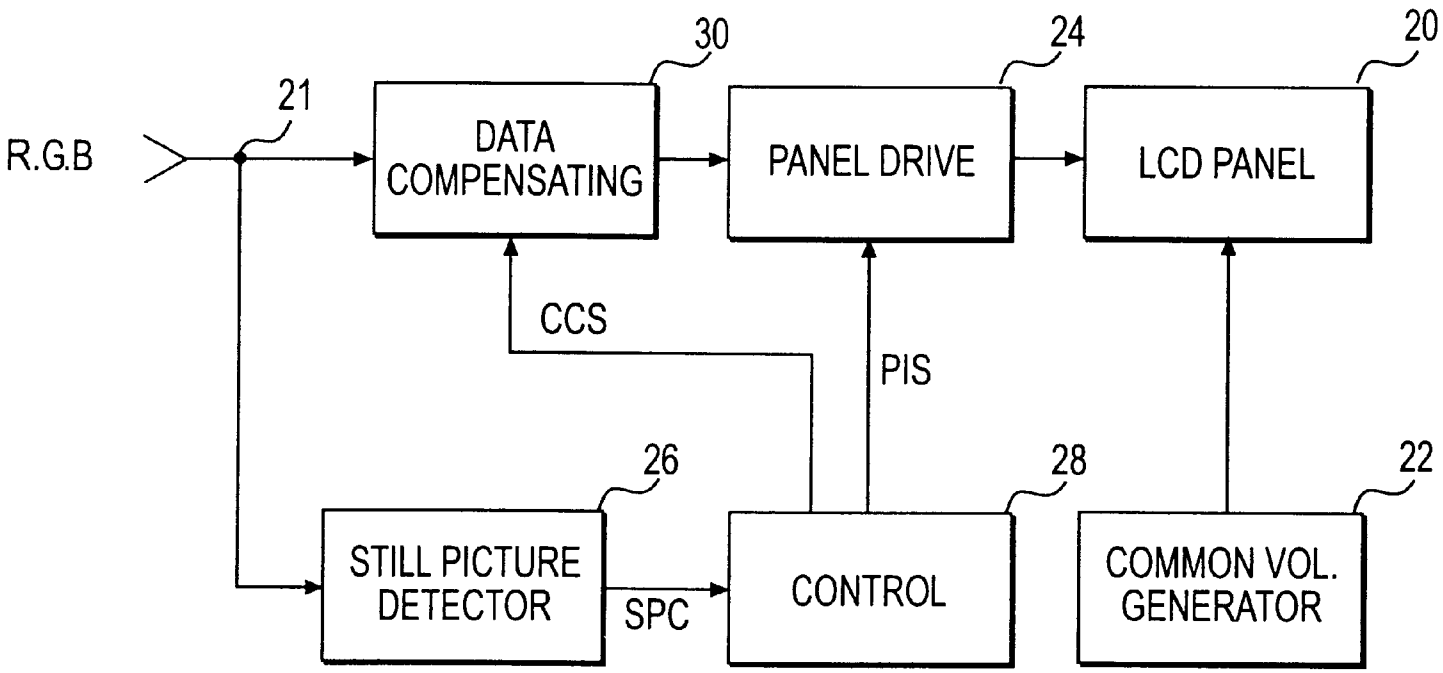
FIG. 3 is a block diagram of a liquid crystal display apparatus of dot inversion type with a residual image eliminating function according to an embodiment of the present invention.

Referring to FIG. 3, there is shown a liquid crystal display apparatus of dot inversion type according to an embodiment of the present invention. The apparatus includes a common voltage generator 22 and a panel driver 24 connected to a liquid crystal display panel 20. The common voltage generator 22 generates a common voltage $V_{COM}$ maintaining a constant voltage level, and commonly applies the common voltage $V_{COM}$ to liquid crystal cells included in the liquid crystal display panel 20.

Moreover, this liquid crystal display apparatus of dot inversion type further includes a still picture detector 26 and a data compensating portion 30 commonly receiving red (R), green (G), and blue (B) color signals from an input line, and a controller 28 receiving a still picture detection signal SPC from the still picture detector 26. The still picture detector 26 compares R, G, and B color signals of the current frame from the input line 21 with those of the previous frame inputted earlier to thereby generate the still picture detection signal SPC indicating whether an image signal identical to the previous image signal, that is, a still picture, is being displayed on the liquid crystal display panel 20. This still picture detection signal SPC has a specific logical value, for example, "1" for one frame period in the case where the R, G, and B color signals of the previous frame are identical to those of the current frame.

The controller 28 monitors the logical value of the still picture detection signal SPC to generate a compensation control signal CCS having a specific logical value in the case where the same image signal remains at a specific logical value successively for a predetermined critical period, that is, for a certain number of frames. Further, the controller 28 generates a polarity inversion control signal PIS having an inverted logical value every frame and applies the polarity inversion control signal PIS to the panel driver 24.

The data compensation portion 30 selectively compensates for the R, G, and B color signals to be delivered from the input line 21 to the panel driver 24 in accordance with a logical value of the compensation control signal CCS from the controller 28. Specifically, the data compensating portion 30 compensates the R, G, and B color signals to be delivered to the panel driver 24 only when the compensation control signal CCS has a specific logical value. Further, the data compensating portion 30 adds a compensation voltage $V^*_c$ to the inputted R, G, and B signals, thereby compensating the R, G, and B color signals. The compensation voltage $V^*_c$ can be calculated by the operation process described below.

First, a DC voltage $V_{rma}$ delivered to the liquid crystal cell in the liquid crystal display panel 20 per each field is calculated by the following formula:

$$\begin{aligned} V_{\text{rms}} &= \left\{(l/T)\cdot\int_0^T V^2\,dt\right\}^{1/2} \\ &= \left\{(l/T)\cdot\int_0^T (\Delta V_{p(\text{data})} - \Delta V_{s(M)}\,dt)\right\}^{1/2} \\ &= (l/T)\cdot(\Delta V_{p(\text{data})} - \Delta V_{s(M)})T \\ &= \Delta_{p(\text{data})} - \Delta V_{s(M)} \end{aligned} \tag{4}$$

Next, by employing the above derived DC voltage $V_{rms}$ per field, an electric charge quantity $Q_{rms}$ delivered to the liquid crystal cell per field is calculated by the following formula:

$$Q_{\text{rms}} = V_{\text{rms}} C_{LC(\text{data})} = (\Delta V_{p(\text{data})} - \Delta V_{s(M)} C_{LC(\text{data})} \tag{5}$$

Subsequently, by employing the above electric charge quantity Qrms delivered to the liquid crystal cell per field, a compensating charge quantity with respect to the liquid crystal cell after a critical period, i.e., 2n fields is obtained by the following formula:

$$Q_{DC} = Q_{rms} \times 2nT \tag{6}$$

Finally, the compensation voltage $V^*_c$ to the liquid crystal cell after the critical period is given as follows:

$$\begin{aligned} V*c &= Q_{\text{rms}}\cdot 2n/C_{LC(\text{data})} \\ &= 2n\cdot(\Delta V_{p(\text{data})} - \Delta V_{s(M)})\cdot C_{LC(\text{data})}/C_{LC(\text{data})} \\ &= 2n\cdot(\Delta V_{p(\text{data})} - \Delta V_{s(M)}) \\ &= V_{\text{rms}} \times 2n \end{aligned} \tag{7}$$

Provided that a constant K related to an affect of other dielectric layers is taken into consideration in addition to a pure capacitance value of the liquid crystal included in the liquid crystal cell in the above formula 6, then the compensation voltage $V^*_c$ for the liquid crystal cell after the critical period is given as follows:

$$V^*_c = K\cdot V_{rms}\cdot 2n \tag{8}$$

Further, the critical period 2n is determined such that the compensation voltage $V^*_c$ has one gray voltage enough to suppress a flicker in gray voltages.

Meanwhile, the panel driver 24 controls the R, G, and B color signals from the data compensating portion 30 to have a polarity corresponding to a logical value of the polarity inversion control signal PIS from the controller 28 on the basis of the common voltage VCOM. Further, the panel driver 24 allows a picture to be displayed on the liquid crystal display panel 20 by applying the polarity controlled R, G, and B color signals to the liquid crystal cells in the liquid crystal display panel 20. The compensated image signal generated for one frame allows a direct-current voltage accumulated in each of the liquid crystal cells in the liquid crystal display panel 20 to be eliminated in the case where the still picture is continuously displayed on the liquid crystal display panel 20 for the critical period. As a result, a fine picture without a residual image can be displayed on the liquid crystal display panel 20.

Figure 4:
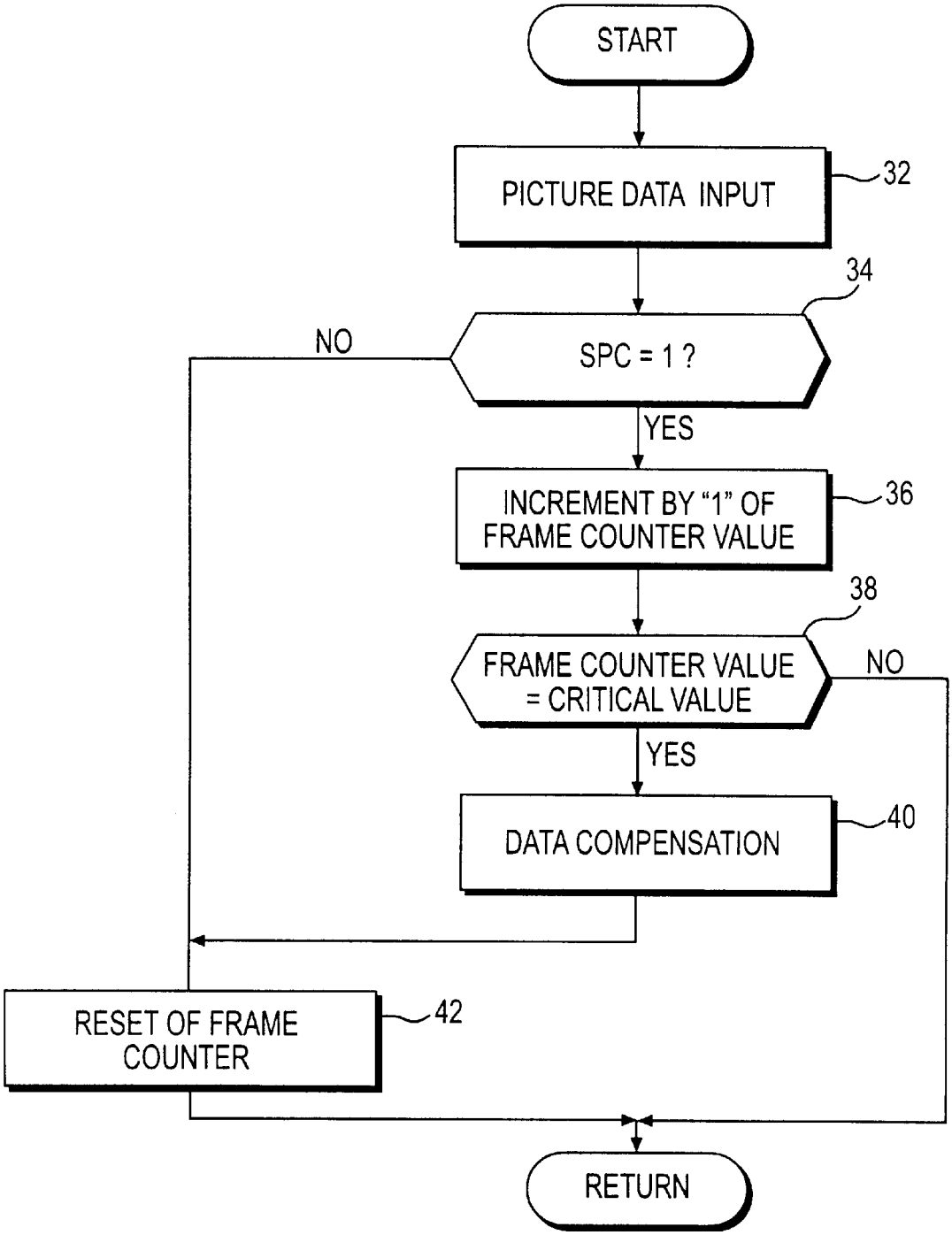
FIG. 4 is a flow chart showing the control procedure performed by the controller shown in FIG. 3.

FIG. 4 is a flow chart for explaining each step in the liquid crystal display method according to this embodiment of the present invention, which is performed by the controller 28 of FIG. 3. An explanation as to each procedure in the flow chart of FIG. 4 follows.

First, if the R, G, and B color signals for one frame unit representing the color picture are sequentially input on the input line 21 in step 32, then the controller 24 checks a logical voltage of the still picture detection signal SPC from the still picture detector 26 to decide whether it is identical to color signals of the previous frame or not in step 34. At this time, if the still picture detection signal SPC has a specifi& logical value, i.e., "1," then the controller 28 judges that a still picture is being displayed on the liquid crystal display panel 20, and increments a value of frame counter included therein by "1", in step 36.

Next, in step 38, the controller 28 checks if a value of the frame counter is the threshold value, for example, n, to thereby decide whether the still picture has successively been displayed for the critical period. At this time, if the value of the frame counter has not reached the threshold value n, then the controller 28 returns to step 32. If the value of the frame counter is equal to the threshold value n, then the controller 28 recognizes that the still picture has been continuously displayed for a critical period and applies the compensation control signal CCS of a specific logical value to the data compensation portion 30 in step 40. Accordingly, the data compensating portion 30 compensates the R, G, and B color signals by calculating the compensation voltage $V^*_c$ and adding the compensation voltage $V^*_c$ to the R, G, and B color signals. The compensated R, G, and B color signals are supplied to the liquid crystal cell in the liquid crystal display panel 20 after they are polarity-controlled by means of the panel driver 24, thereby offsetting the direct-current voltage components accumulated in the liquid crystal cell. As a result, a residual image does not appear in the liquid crystal display panel 20.

Finally, either when the still picture detection signal SPC does not have a specific logical value in step 34 or after the performance of step 40, the controller 28 initializes the value of the frame counter to "0" and returns to step 32.

Figure 5:
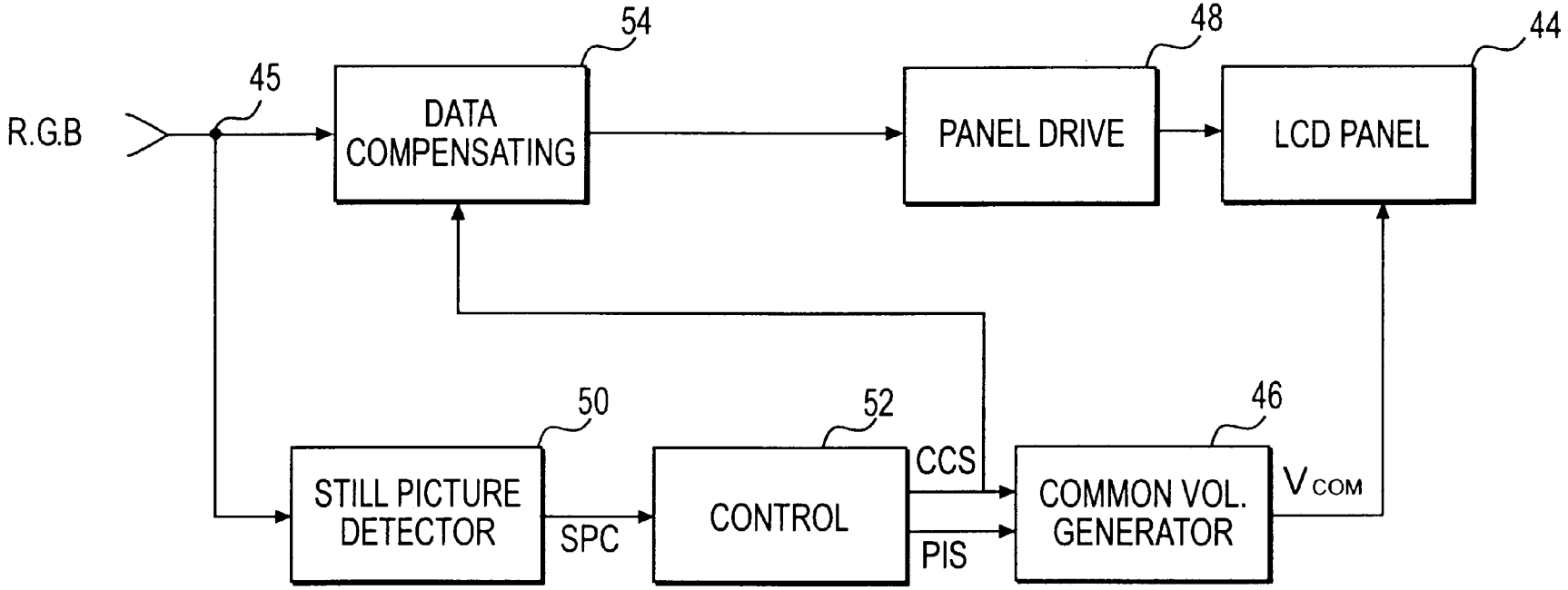
FIG. 5 is a block diagram of a liquid crystal display apparatus of dot inversion type with a residual image eliminating function according to another embodiment of the present invention.

Referring to FIG. 5, there is shown a liquid crystal display apparatus of dot inversion type according to another embodiment of the present invention which includes a common voltage generator 46 and a panel driver 48 connected to a liquid crystal display panel 44. Also, this liquid crystal display apparatus of dot inversion type further includes a still picture detector 50 and a data compensating portion 54 commonly receiving red (R), green (G) and blue (B) color signals from a input line 45, and a controller 52 receiving a still picture detection signal SPC from the still picture detector 50.

The still picture detector 50 compares the R, G, and B color signals of the current frame from the input line 45 with those of the previous frame inputted earlier to thereby generate the still picture detection signal SPC indicating whether an image signal identical to the previous image signal, that is, a still picture, is being displayed on the liquid crystal display panel 44. This still picture detection signal SPC is set to a specific logical value, for example, "1" for one frame period in the case where the R, G, and B color signals of the previous frame are identical to those of the current frame.

The controller 52 monitors the logical value of the still picture detection signal SPC to generate a compensation control signal OCS having a specific logical value in the case where the same image signal remains at a specific logical value successively for a predetermined critical period, that is, for a certain number of frames. Further, the controller 52 generates a polarity inversion control signal PIS having a inverted logical value every frame and applies the polarity inversion control signal PIS to the common voltage generator 46.

The data compensating portion 54 selectively compensates the R, G, and B color signals to be delivered from the input line 45 to the panel driver 48 in accordance with a logical value of the compensation control signal CCS from the controller 28. Specifically, the data compensation portion 54 compensates the R, G, and B color signals to be delivered to the panel driver 48 only when the compensation control signal CCS has a specific logical value. Further, the data compensating portion 54 adds a compensation voltage $V^*_c$ to the inputted R, G, and B signals, thereby compensating the R, G, and B color signals.

The common voltage generator 46 generates a common voltage $V_{COM}$ varied in accordance with logical values of the polarity inversion control signal PIS and the compensation control signal CCS from the controller 52, and commonly supplies the common voltage $V_{COM}$ to the liquid crystal cells included in the liquid crystal display panel 44. This common voltage $V_{COM}$ has a maximum voltage level when the compensation control signal CCS has a grounded logical value and the polarity inversion control signal PIS has a specific logical value; and a minimum voltage level when both the compensation control signal CCS and the polarity inversion control signal PIS have a grounded logical value. Also, the common voltage $V_{COM}$ remains at an intermediate voltage level when the compensation control signal CCS has a specific logical value.

The panel driver 48 allows a picture to be displayed on the liquid crystal display panel 44 by applying the polarity-controlled R, G, and B color signals to the liquid crystal cells in the liquid crystal display panel 44. The compensated image signal generates for one frame and the common voltage $V_{COM}$ of an intermediate voltage level eliminate the DC voltage accumulated in each of the liquid crystal cells in the liquid crystal display panel 44 when a still picture is continuously displayed on the liquid crystal display panel 44, for the critical period. As a result, a fine picture without a residual image can be displayed on the liquid crystal display panel 44.

Figure 6:
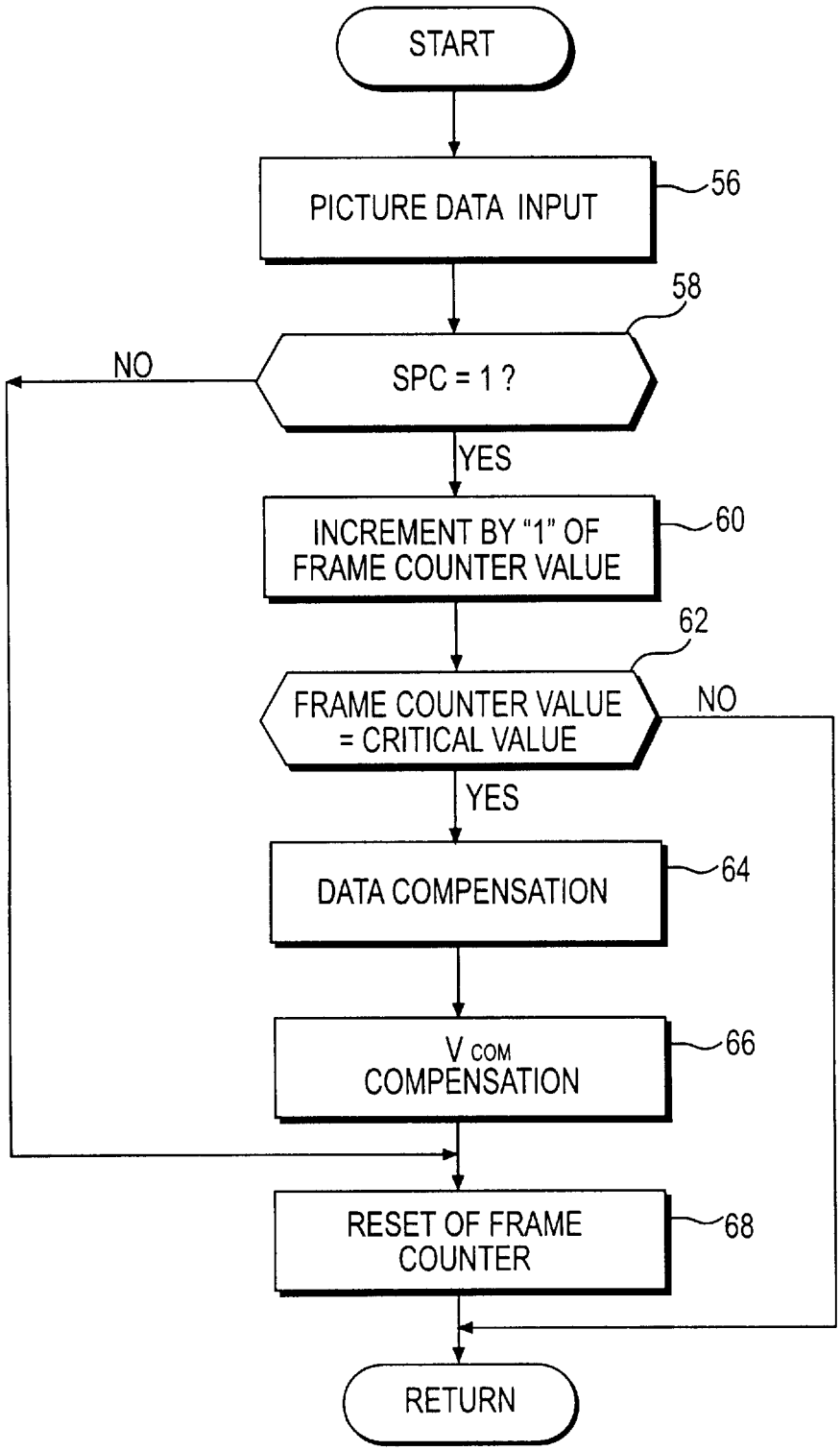
FIG. 6 is a flow chart for explaining a control procedure performed by means of the controller shown in FIG. 5.

FIG. 6 is a flow chart for explaining each step in the liquid crystal display method according to this embodiment of the present invention, which is performed by the controller 52 of FIG. 5. An explanation as to each procedure in the flow chart of FIG. 6 follows.

First, the R G, and B color signals representing the color picture for one frame are sequentially input on the input line 45 in step 56. Then, in step 58, the controller 52 checks the logical voltage of the still picture detection signal SPC from the still picture detector 50 to decide whether it is identical to color signals of the previous frame. If the still picture detection signal SPC has a specific logical value, e.g., "1", then the controller 52 judges that a still picture is being displayed on the liquid crystal display panel 44, and, in step 60, increments a value of a frame counter included therein by "1".

Next, in step 62, the controller 52 checks if a value of the frame counter is the critical value, for example, n, to thereby decide whether the still picture has been successively displayed for the critical period. If the value of the frame counter has not reached the threshold value n, then the controller 52 returns to step 32.

If the value of the frame counter is equal to the threshold value n, then the controller 52 recognizes that the still picture has been continuously displayed during the critical period and, in step 64, applies the compensation control signal CCS of a specific logical value to both the data compensating portion 54 and common voltage generator 46. Accordingly, the data compensating portion 54 compensates the R, G, and B color signals by calculating the compensation voltage $V'_c$ and adding the compensation voltage $V'_c$ to the R, G, and B color signals from the input line 45. The compensated R, G, and B color signals are supplied to the liquid crystal cells in the liquid crystal display panel 44 by way of the panel driver 48. Further, in step 66, the common voltage generator 46 generates the common voltage $V_{COM}$ of intermediate voltage level by the compensation control signal CCS of specific logical value from the controller 52, and applies the common voltage $V_{COM}$ to the liquid crystal cells in the liquid crystal display panel 44. Using these compensated R, G, and B color signals and the common voltage $V_{COM}$ of intermediate voltage level, the DC component accumulated in the liquid crystal cell during the critical period is eliminated. As a result, a residual image does not appear in the liquid crystal display panel 44.

Finally, either when the still picture detection signal SPC does not have a specific logical value in step 58 or after the performance of step 66, the controller 52 initializes the value of the frame counter to "0" and then returns to step 56.

Figure 7:
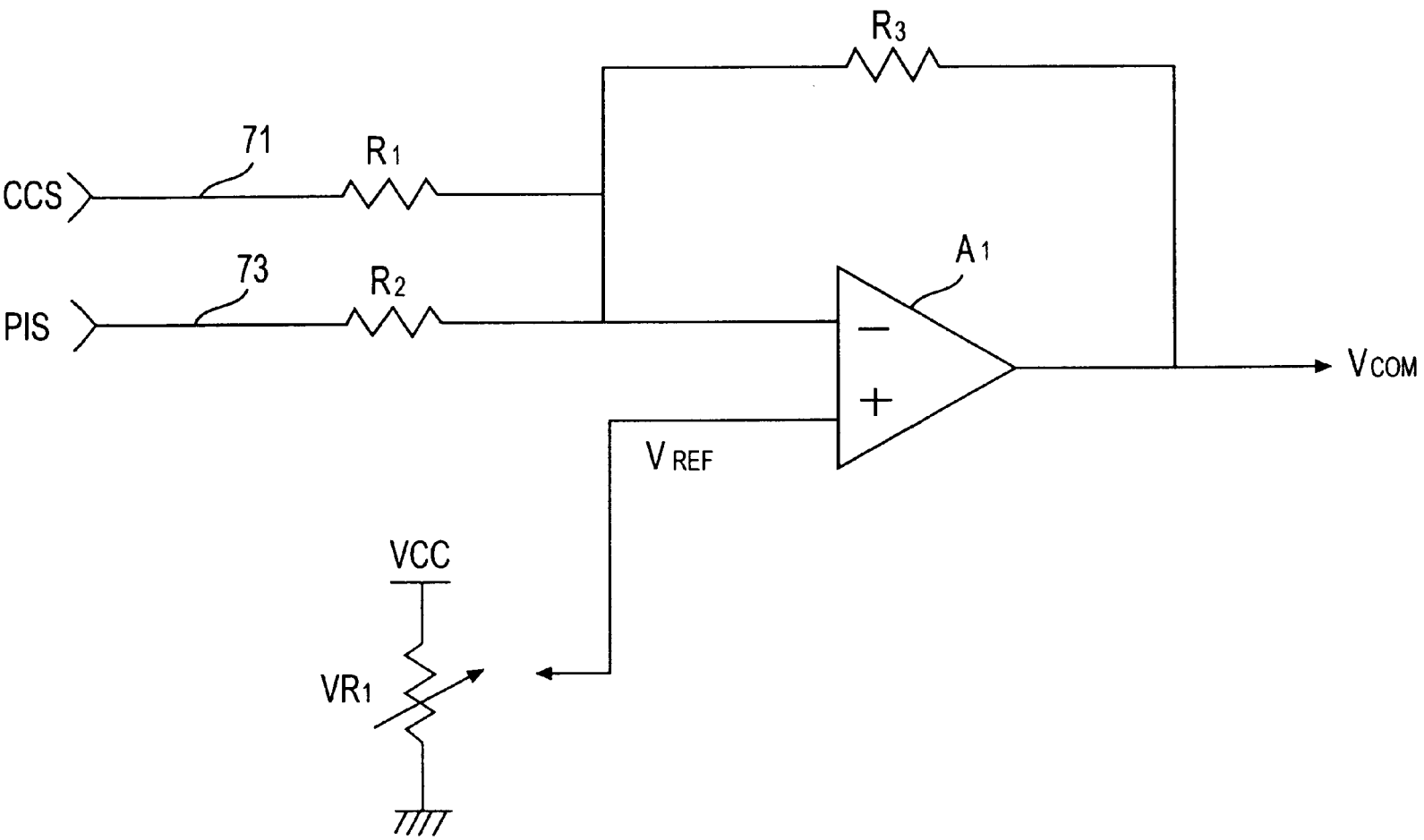
FIG. 7 is a detailed circuit diagram of the common voltage generator shown in FIG. 5.

FIG. 7 is a detailed circuit diagram of the common voltage generator 46 shown in FIG. 5. Referring now to FIG. 7, the common voltage generator 46 includes a variable resistor VRI connected between a voltage supply VCC and ground GND for generating a reference voltage VREF, a first resistor RI connected between the input line 71 and an inverting terminal (−) of operational amplifier A1, a second resistor R2 connected between the second input line 73 and the inverting terminal (−) of operational amplifier A1, and a third resistor R3 for feedback connected between the inverting terminal and an output terminal of operational amplifier A1. The operational amplifier A1 adds a compensation control signal CCS from the first input line 71 to a polarity inversion control signal PIS from the second input line 73, and then inverts and amplifies the added voltage on the basis of a reference signal VREF from the variable resistor VR1. This common voltage VCOM is applied to the liquid crystal cells included in the liquid crystal display panel 44 as shown in FIG. 5, and has a maximum voltage level, a minimum voltage level or an intermediate voltage level in accordance with logical values of the compensation control signal CCS and the polarity inversion control signal PIS.

As described above, a liquid crystal display apparatus with the residual image eliminating function according to an embodiment of the present invention compensates an image signal for one frame and/or controls the common voltage in the case where the still picture is continuously displayed for more than a certain time, so that it can eliminate the direct-current voltage component accumulated in the liquid crystal cells included in the liquid crystal display panel. Accordingly, even though the still picture is continuously displayed for more than a certain time, the liquid crystal display apparatus with the residual image eliminating function according to the present invention prevents a residual image from appearing on the liquid crystal display panel.

Figure 8:
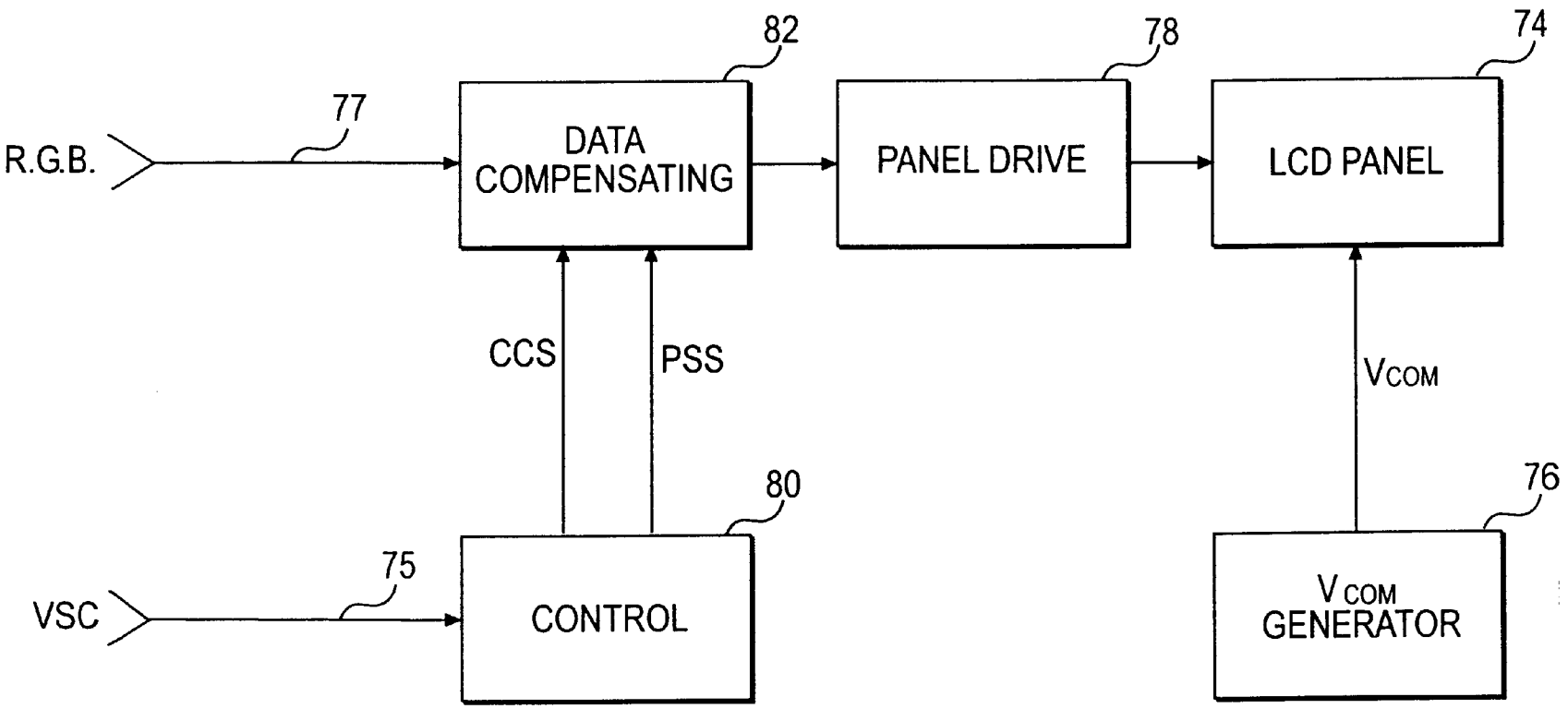
FIG. 8 is a block diagram of a liquid crystal display apparatus of alternative inversion type with a residual image eliminating function according to another embodiment of the present invention.

Referring to FIG. 8, there is shown a liquid crystal display apparatus of alternative inversion type according to another embodiment of the present invention. The apparatus includes a common voltage generator 76 and a panel driver 78 connected to a liquid crystal display panel 74. The common voltage generator 74 generates a common voltage $V_{COM}$ maintaining a constant voltage level, and commonly applies the common voltage $V_{COM}$ to liquid crystal cells included in the liquid crystal display panel 74.

Moreover, this liquid crystal display apparatus of alternative inversion type further includes a controller (or control) 80 receiving a vertical synchronous signal VSC from an input line 75, and a data compensating portion 82 receiving red (R), green (G), and blue (B) color signals from an input bus 77.

The controller 80 is repeatedly counted until a critical value 2N (where, N is an even number) by means of the vertical synchronous signal VSC from the input line 75. Whenever the counted value reaches the critical value 2N, that is, whenever N frame picture signals are received, the controller 80 generates a compensation control signal CCS that allows the picture signals to perform the compensation operation. Whenever 2N vertical synchronous signals VSC are inputted, the compensation control signal CCS maintains a specific logical value, e.g., "1" or "1" during one frame interval while maintaining a ground logical value, e.g., "0" or "1" during the remaining interval. Also, the controller 80 generates a pixel selection signal PSS changing from a specific logical value, e.g., "1", into a ground logical value, e.g., "0", or vice versa, whenever 2N vertical synchronous signals are received. In this pixel selection signal PSS, the specific logical value indicates to compensate pixels having a positive voltage in the picture signals, whereas the ground logical value does to compensate pixels having a negative voltage in the picture signal.

The data compensating portion 82 periodically performs a compensation operation of the R, G, and B color signals to be delivered from the input bus 77 to the panel driver 78 in accordance with a logical value of the compensation control signal CCS from the controller 80. Upon compensation of the picture signals, the data compensating portion 82 compensates only R, G, and B signals having a positive or negative voltage in the R, G, and B signals in accordance with a logical value of the pixel selection signal PSS.

Specifically, the data compensating portion 82 compensates only R, G, and B signals having a positive voltage in the R, G, and B signals when the pixel selection signal PSS has a specific logical value; while compensating only R, G, and B signals having a negative voltage in the R, G, and B signals when the pixel selection signal PSS has a ground logical value. As a result, the data compensating portion 82 alternatively compensates the negative pixel signals and the positive pixel signals whenever a specific even number of frame picture signals are displayed on the liquid crystal panel 74, thereby compensating a DC voltage accumulated in the liquid crystal cells once every interval when 4N frame picture signals are displayed. This stems from a pixel voltage applied to the liquid crystal cell being inverted every frame interval and having the polarity contrary to pixel voltages applied to the adjacent liquid crystal cells. The positive R, G, and B color signals are compensated by subtracting a compensating voltage $V^*_C$ therefrom, whereas the negative R, G, and B color signals are compensated by adding the compensation voltage $V^*_c$ thereto. The compensation voltage $V^*_c$ is calculated as seen from the description of the first embodiment.

The panel driver 78 allows a picture to be displayed on the liquid crystal display panel 74 by applying the R, G, and B color signals from the data compensating portion 82 to the liquid crystal cells in the liquid crystal display panel 74.

The liquid crystal display apparatus configured as described above alternately compensates the positive pixel signals and the negative pixel signals every specific even number of frame interval, thereby eliminating the DC voltages accumulated in the liquid crystal cells. Accordingly, it prevents a residual image from appearing on the liquid crystal display panel.

Alternatively, if the critical value 2N is set to be odd number rather than even number, then the positive or negative R, G, and B signals only are compensated whenever a specific odd number of frame picture signals are displayed, thereby eliminating the DC voltages accumulated in all liquid crystal cells in the liquid crystal display panel. In this case, it becomes possible to omit the pixel selection signal PSS and to simplify the circuit configuration of both the controller and the data compensating portion.

Figure 9:
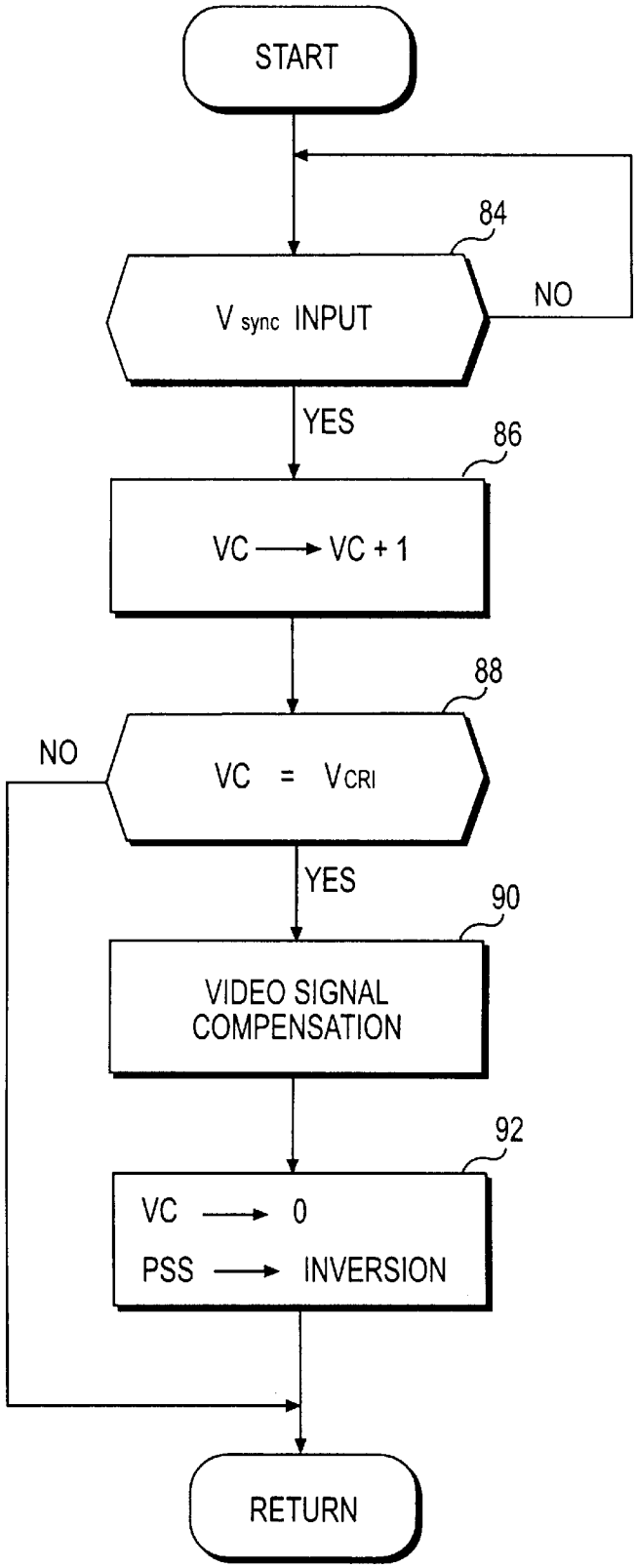
FIG. 9 is a flow chart for explaining a control procedure performed by means of the control shown in FIG. 8.

FIG. 9 is a flow chart for explaining each step in the liquid crystal display method according to the embodiment of the present invention of FIG. 8, which is performed by the controller 80 of FIG. 8. An explanation as to each procedure in the flow chart of FIG. 9 follows.

First, the controller 80 waits until the vertical synchronous signal VSC is received in step 84. Then, in step 86, if the vertical synchronous signal VSC is inputted, then the controller 80 increments a value of a synchronizing counter VC assigned to a register therein by "1". Subsequently, in step 88, the controller 82 check if the value of the synchronizing counter VC is equal to a critical value ($V_{CRI}$=2N) to thereby decide whether N frame intervals have lapsed or not. If the value of the synchronizing counter VC has not reached the critical value $V_{CRI}$, then the controller 82 returns to step 84.

Otherwise, if the value of the synchronizing counter VC is the critical value $V_{CRI}$, then the controller 82 regards it as the lapse of N frame intervals to apply a compensation control signal CCS having a specific logical value of pulse to the data compensating portion 82 in step 90. Then, the data compensating portion 82 calculates a compensation voltage $V^*_c$. Subsequently, the data compensating portion 82 subtracts R, G, and B signals having a positive voltage in the R, G, and B color signals from the input bus 77 by the compensation voltage $V^*_c$, or adds the compensation voltage $V^+_c$ to R, G, and B signals having a negative voltage in the R, G, and B color signals from the input bus 77 in accordance with a logical value of the pixel selection signal PSS, thereby compensating the R, G, and B signals. These compensated R, G, and B color signals are applied via the panel driver 78, to the liquid crystal cells in the liquid crystal display panel 74, thereby cancelling the DC voltage component accumulated in the liquid crystal cells. Accordingly, no residual image appears on the liquid crystal display panel 74.

Next, the controller 80 initializes the value of the synchronizing counter VC and inverting the logical value of the pixel selection signal PSS, and then returns to step 84.

It should be noted that the embodiments discussed above will also function to eliminate a residual image without the use of a still picture detector. In this case, the R, G, and B signals are input directly to the controller 28 of FIG. 3 and the controller 52 of FIG. 5. These controllers then count the number of frames according to the input data and generate a CCS signal having a logical value of "1" after a predetermined number of frames. Thus, compensation occurs periodically, whether or not the same picture has been displayed for a certain time.

Although the present invention has been explained by the embodiments shown in the drawings described above, it should be understood to the ordinary skilled person in that art that the invention is not limited to the disclosed embodiments, but rather that various changes or modifications thereof are possible without departing from the spirit of the invention. Accordingly, the scope of the invention shall be determined only by the appended claims and their equivalents.

What is claimed is:

1. A liquid crystal display apparatus for use with a liquid crystal display panel made up of liquid crystal cells, having a function of eliminating a residual image, comprising:

means for receiving image signals on an input line;

means for determining a compensation voltage corresponding to a direct-current voltage amount accumulated in a liquid crystal cell;

a still picture detector for comparing the image signals and for outputting a predetermined signal if a picture has been displayed on the liquid crystal display panel for a predetermined time; and a data compensator for compensating the image signals with the compensation voltage in response to the predetermined signal from the still picture detector.

2. The liquid crystal display apparatus of claim 1 wherein the still picture detector compares a current frame image signal from said input line with a previous frame image signal, increments a number whenever the current frame image signal is identical to a previous frame image signal, and outputs the predetermined signal when the number reaches a predetermined value.

3. A liquid crystal display apparatus for use with a liquid crystal display panel made up of liquid crystal cells, having a function of eliminating a residual image, comprising:

means for receiving image signals on an input line;

means for determining a compensation voltage corresponding to a direct-current voltage amount accumulated in a liquid crystal cell over a period of time spanning two or more frames;

a data compensator for compensating the image signals with the compensation voltage after the period of time; and a common voltage generator for varying a common voltage to compensate for the accumulated direct-current voltage.

4. The liquid crystal display apparatus of claim 3 wherein the data compensator compensates the image signal periodically.

5. The liquid crystal display apparatus of claim 3 wherein the common voltage generator varies the common voltage to compensate for the accumulated direct-current voltage periodically.

6. The liquid crystal display apparatus of claim 3 further including:

a still picture detector for comparing the image signals and for outputting a predetermined signal if a picture has been displayed on the liquid crystal display panel for a predetermined time, wherein the data compensator compensates the image signal in response to the predetermined signal from the still picture detector.

7. The liquid crystal display apparatus of claim 6 wherein the common voltage generator varies the common voltage in response to the predetermined signal.

8. The liquid crystal display apparatus of claim 6 wherein the still picture detector compares a current frame image signal from said input line with a previous frame image signal, increments a number whenever the current frame image signal is identical to a previous frame image signal, and outputs the predetermined signal when the number reaches a predetermined value.

9. The liquid crystal display apparatus of claim 3 wherein the common voltage generator sets the common voltage to an intermediate value between the peak values of the common voltage to compensate for the accumulated direct-current voltage.

10. In a liquid crystal display apparatus for displaying a picture on a liquid crystal display panel that switches liquid crystal cells therein using thin film transistors, a method of eliminating a residual image comprising the steps of:

receiving image signals on an input line;

determining a compensation voltage corresponding to a direct-current voltage amount accumulated in a liquid crystal cell;

comparing the image signals and outputting a predetermined signal if a picture has been displayed on the liquid crystal display panel for a predetermined time; and compensating the image signals with the compensation voltage in response to the predetermined signal.

11. The method of claim 10, wherein the comparing and outputting step includes the steps of:

comparing a current frame image signal from said input line with a previous frame image signal;

incrementing a number whenever the current frame image signal is identical to a previous frame image signal; and outputting the predetermined signal when the number reaches a predetermined value.

12. In a liquid crystal display apparatus for displaying a picture on a liquid crystal display panel that switches liquid crystal cells therein using thin film transistors, a method of eliminating a residual image comprising the steps of:

receiving image signals on an input line;

determining a compensation voltage corresponding to a direct-current voltage amount accumulated in a liquid crystal cell over a period of time spanning two or more frames;

compensating the image signals with the compensation voltage after the period of time; and varying a common voltage to compensate for the accumulated direct-current voltage.

13. The method of claim 12 wherein the compensating step includes the step of:

compensating the image signal periodically.

14. The method of claim 12 wherein the varying step includes the step of:

varying the common voltage to compensate for the accumulated direct-current voltage periodically.

15. The method of claim 12 further including the steps of:

comparing the image signals and outputting a predetermined signal if a picture has been displayed on the liquid crystal display panel for a predetermined time; and compensating the image signal in response to the predetermined signal.

16. The method of claim 15, wherein the comparing and outputting step includes the steps of:

comparing a current frame image signal from said input line with a previous frame image signal;

incrementing a number whenever the current frame image signal is identical to a previous frame image signal; and outputting the predetermined signal when the number reaches a predetermined value.

17. The method of claim 15 wherein the varying steps includes the step of:

varying the common voltage in response to the predetermined signal.

18. The method of claim 12 wherein the varying step includes the step of:

varying the common voltage to an intermediate value between the peak values of the common voltage to compensate for the accumulated direct-current voltage.

* * * * *